US005957594A

United States Patent [19]

Loidl

[11] Patent Number: 5,957,594

[45] Date of Patent: Sep. 28, 1999

[54] THERMO-TAPE UNIT HAVING A THERMO-TAPE PROVIDED WITH AT LEAST ONE MARKING STRIPE CONFIGURATION

[75] Inventor: Martin Loidl, St. Pölten, Austria

[73] Assignee: U.S. Philips Corporation, New York, N.Y.

[21] Appl. No.: 09/085,683

[22] Filed: May 27, 1998

[30] Foreign Application Priority Data

May 28, 1997 [EP] European Pat. Off. ..... 97890096

[51] Int. Cl.[6] ..... B41J 31/00

[52] U.S. Cl. ..... 400/237; 400/238; 400/240

[58] Field of Search ..... 400/207, 237, 400/238, 239, 240, 240.1, 240.2, 240.3, 240.4, 247, 249, 218, 219, 219.1, 208

[56] References Cited

U.S. PATENT DOCUMENTS

| | | | |
|---|---|---|---|
| 4,797,016 | 1/1989 | Lahr | 400/237 |
| 5,803,627 | 9/1998 | Paranjpe | 400/240 |

FOREIGN PATENT DOCUMENTS

| | | | |
|---|---|---|---|
| 60-180369 | 9/1985 | Japan . | |
| 61-146585 | 7/1986 | Japan | 400/238 |
| 62-142676 | 6/1987 | Japan | 400/237 |
| 1-67368 | 3/1989 | Japan | 400/237 |
| 2-263680 | 10/1990 | Japan | 400/237 |
| 5-305727 | 11/1993 | Japan | 400/237 |
| 6-191069 | 7/1994 | Japan | 400/237 |

*Primary Examiner*—Christopher A. Bennett
*Attorney, Agent, or Firm*—Robert J. Kraus

[57] ABSTRACT

In a thermo-tape unit (1) having a supply reel hub (2) and a supply roll (5) of thermo-tape (6) wound on the supply reel hub (2), the thermo-tape has at least one marking stripe configuration (14) at least in its leading area (8), which configuration comprises at least one marking stripe section (15, 16, 17) having a given section dimension (L1, L2, L3) in the longitudinal direction (L) of the thermo-tape (6), and at least one characteristic of the thermo-tape unit (1) is encoded by means of this section dimension (L1, L2, L3) of the marking stripe section (15, 16, 17).

7 Claims, 2 Drawing Sheets

THERMO-TAPE UNIT HAVING A THERMO-TAPE PROVIDED WITH AT LEAST ONE MARKING STRIPE CONFIGURATION

BACKGROUND OF THE INVENTION

The intention relates to a thermo-tape unit comprising a supply reel hub and a supply roll of thermo-tape wound on the supply reel hub, which thermo-tape has a trailing area adjoining the supply reel hub and a leading area remote from the supply reel hub, and a front side provided with an ink layer activable under the influence of heat and a back side at the reverse of the front side.

Such a thermo-tape unit of the type defined in the opening paragraph is commercially available from Phillips Electronics under the type number or ordering number PFA230. As thermo-tape the known thermo-tape unit comprises a so-called thermo-transfer foil whose front side carries an ink layer which is removable under the influence of heat, so that through point-by-point heating of the thermo-transfer foil by means of a thermal printer head the ink layer of the thermo-transfer tape, which basically consists of a special wax, can be transferred to normal paper in a point-by-point fashion. Such a thermo-transfer foil is used in facsimile equipment in which the received document is printed on normal paper by means of a thermal printer head and a thermo-transfer foil.

In the known thermo-tape unit it has proved to be unfavorable that with this thermo-tape unit it is not possible when the thermo-tape unit is mounted in an apparatus adapted to cooperate with this thermo-tape unit to transfer information about the characteristics of the thermo-tape unit, particularly its thermo-tape, to the apparatus.

It is to be noted that it is already known from a commercially available thermo-tape unit of the type defined in the opening paragraph to put such a thermo-tape unit only on the market in combination with a data carrier card, i.e. a so-called chip card, which data carrier card has a memory which stores data or information about characteristics of the thermo-tape unit and should also be inserted into an apparatus adapted to cooperate with the thermo-tape unit when this thermo-tape unit is mounted into the apparatus. This solution enables information about characteristics of the thermo-tape unit stored in the data carrier card to be transferred to the apparatus. However, such a separate data carrier card is comparatively costly, resulting in a more expensive thermo-tape unit, and moreover a separate operation is necessary to insert the data carrier card into the apparatus and, consequently, to enter the information relating to characteristics of the thermo-tape unit and stored in the data carrier card into the apparatus.

SUMMARY OF THE INVENTION

It is an object of the invention to preclude the aforementioned unfavorable situation with a thermo-tape unit of the type defined in the opening paragraph and to provide an improved thermo-tape unit including means making it possible in a simple manner to enter information about at least one characteristic of the thermo-tape unit into an apparatus adapted to cooperate with the thermo-tape unit when this thermo-tape unit is mounted in this apparatus.

According to the invention, in order to achieve this object, a thermo-tape unit of the type defined in the opening paragraph is characterized in that at least in its leading area the thermo-tape has at least one marking stripe configuration which comprises at least one marking stripe section having a given section dimension which extends in the longitudinal direction of the thermo-tape, and at least one characteristic of the thermo-tape unit is encoded by means of the section dimension which extends in the longitudinal direction of the thermo-tape. In this way, it is achieved by particularly simple and cheap means that in a thermo-tape unit in accordance with the invention information about at least one characteristic of the thermo-tape unit can simply be entered into an apparatus adapted to cooperate with this thermo-tape unit. Thus, it is achieved that in such an apparatus the means for entering information about at least one characteristic of the thermo-tape unit into this apparatus are automatically introduced into this apparatus when the thermo-tape unit is mounted in this apparatus without the necessity to use separate means such as a data carrier card.

In a thermo-tape unit in accordance with the invention having the desired result can be achieved in the simplest case by means of a marking stripe configuration comprising only one marking stripe section. Such a single marking stripe section also enables two characteristics of the thermo-tape unit to be encoded by means of the section dimension in the longitudinal direction of the thermo-type. In accordance with a preferred form of the invention the marking stripe configuration comprises at least two marking stripe sections which extend in the longitudinal direction of the thermo-tape and which each have a given section dimension which extends in the longitudinal direction of the thermo-tape, a spacing being provided between the at least two marking stripe sections, which spacing has a given spacing dimension which extends in the longitudinal direction of the thermo-tape. At least one characteristic of the thermo-tape unit is encoded by means of the section dimension of a least one marking stripe section, which section dimension extends in the longitudinal direction of the thermo-tape, and by means of the spacing dimension of at least one spacing between two marking stripe sections, which spacing dimension extends in the longitudinal direction of the thermo-tape. Thus, it is achieved in a simple manner that a plurality of characteristics of a thermo-tape unit are encoded easily and can also be detected simply and reliably.

In a thermo-tape unit in accordance with the invention each marking stripe configuration can consist of a material having different capacitive or different inductive or different mechanical properties in comparison with the thermo-tape. However, in such a thermo-tape unit it has proved to be very advantageous is the marking stripe section includes an optically-scannable material. This has proved to be advantageous in order to achieve that the marking stripe sections can be scanned in a most simple and reliable manner.

It has proved to be particularly advantageous if, in addition, the marking stripe section includes a reflecting-ink layer. Such a construction has proved to be particularly advantageous in order to achieve that the marking stripe sections can be scanned in a most simple and reliable manner.

In a thermo-tape unit in accordance with the invention it has further proved to be advantageous if, in addition to the marking stripe configuration in the leading area of the thermo-tape, there has been provided at least one further marking stripe configuration disposed in line with this marking stripe configuration in the longitudinal direction of the thermo-tape. Thus its is achieved in a simple manner that even in the case of an intermediate removal of a thermo-tape unit in accordance with the invention from an apparatus adapted to cooperate with this thermo-tape unit and a subsequent replacement of the thermo-tape unit into this apparatus always up-to-date information about the thermo-tape unit can be entered into the apparatus by means of the successively provided marking stripe configurations.

In a thermo-tape unit in accordance with the invention each marking stripe configuration can be provided at the front side of the thermo-tape. It has proved to be particularly advantageous if, in addition, a marking stripe configuration is disposed on the back side of the thermo-tape. This guarantees that a marking stripe configuration cannot adversely affect the heating of the ink layer which is disposed at the front side of the thermo-tape and which can be activated under the influence of heat.

In a thermo-tape unit in accordance with the invention the thermo-tape can be so-called thermo-paper having an ink layer which can be activated under the influence of heat, so that in known manner visible information can be generated on the thermo-paper by a point-by-point cooperation with a thermal printer head. It has proved to be very advantageous if the thermo-tape is formed by a thermo-transfer foil whose front side has been provided with an ink layer which is removable under the influence of heat. This is very advantageous because, particularly for a thermo-transfer foil, it has proved to be important that information about the characteristics of such a thermo-transfer foil can simply be entered into an apparatus adapted to cooperate with such a thermo-transfer foil.

The afore-mentioned aspects as well as further aspects of the invention will be apparent from the embodiments described hereinafter by way of examples and will be elucidated by means of these embodiments.

BRIEF DESCRIPTION OF THE DRAWING

The invention will now be described in more detail with reference to four embodiment shown in the drawings and given by way of examples, but to which the invention is not limited.

DESCRIPTION OF THE PREFERRED EMBODIMENTS

Figure 1:
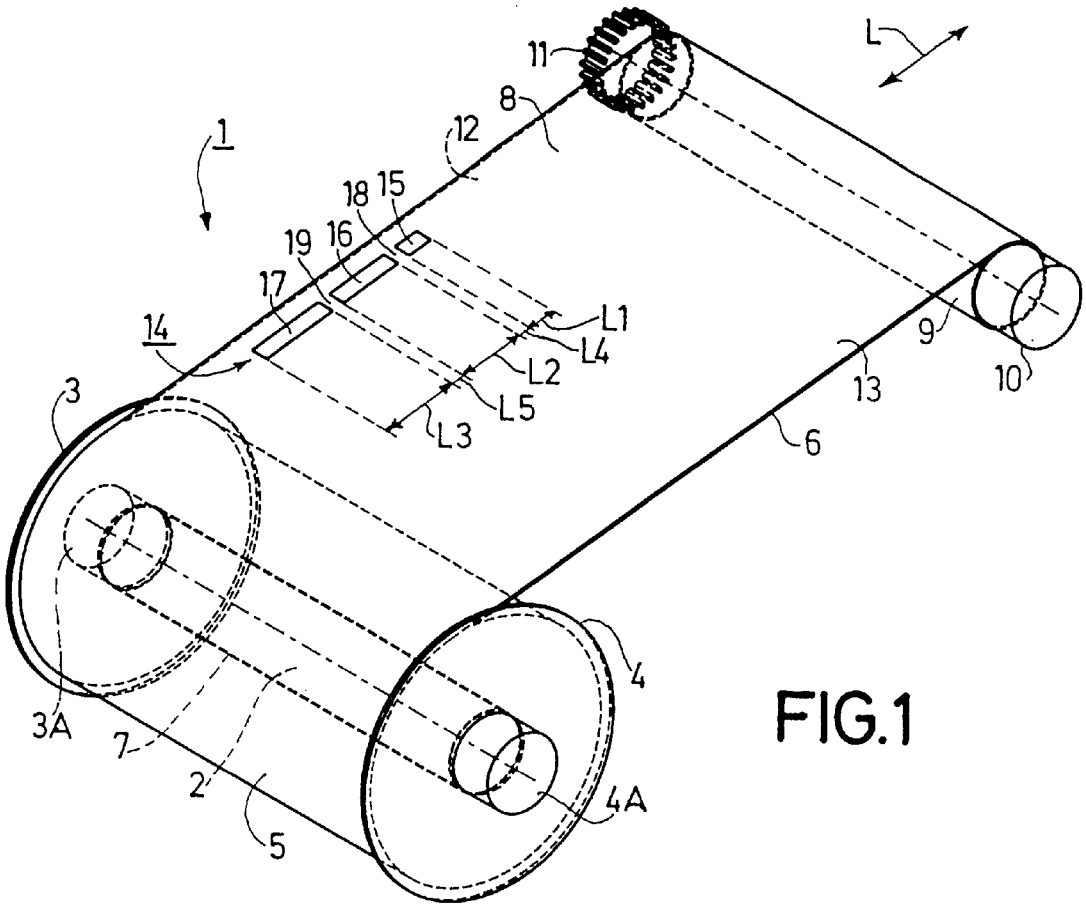
FIG. 1 is a smaller than full-scale oblique view showing a thermo-tape unit in accordance with a first embodiment the invention.

FIG. 1 shows a thermo-tape unit 1. The thermo-tape unit 1 comprises a roller-like or tube-like supply reel hub 2 having a flange, 3 and 4 respectively, at either of its two ends. A journal 3A or 4A projects laterally from each of the two flanges 3 and 4, respectively. By means of the two journals 3A and 4A the supply reel hub 2 with its flanges 3 and 4 and its supply roll 5 can be mounted so as to be rotatable in an apparatus adapted to cooperate with the thermo-tape unit 1. The supply reel hub and the two flanges 3 and 4 form an integral part. The thermo-tape unit 1 further accommodates a supply roll 5 of thermo-tape 6 wound on the supply reel hub 2. The thermo-tape 6 has a trailing area 7 which adjoins the supply reel hub 2 and is attached to the supply reel hub 2 by means of an adhesive.

The thermo-tape 6 further has a leading area 8 which is remote from the supply reel hub 2. In the leading area 8 the thermo-tape 6 of the thermo-tape unit 1 is affixed to a take-up reel hub 9 by means of an adhesive. The take-up reel hub 9 has a toothed wheel 11 connected to one of its two ends and a journal 10 to the other one of its two ends. When thermo-tape 1 has been mounted in an apparatus adapted to cooperate with the thermo-tape unit 1 the take-up reel hub 9 is rotationally drivable via the toothed wheel 11 so as to unwind the thermo-tape 6 from the supply reel hub 2 and wind it onto the take-up reel hub 9.

The thermo-tape 6 has a front side 12 provided with an ink layer which can be activated under the influence of heat and, at the reverse of the front side 12, a back side 13. In the thermo-tape unit 1 shown in FIG. 1 the thermo-tape 6 is formed by a thermo-transfer foil whose front side 12 carries an ink layer which is removable under the influence of heat, the removable ink layer basically consisting of a special wax, which is known per se.

An advantageous feature provided in the thermo-tape unit 1 shown in FIG. 1 is that in its leading area 8 the thermo-tape 6 has been provided with a marking stripe configuration 14, which in the present case comprises three marking stripe sections 15, 16 and 17 which extend in the longitudinal direction L of the thermo-tape 6 indicated by a double arrow and which each have a given section dimension L1, L2 and L3, respectively, in the longitudinal direction L of the thermo-tape 6. In the present case the three section dimensions L1, L2 and L3 differ from one another. However, it is evident that alternatively the section dimensions L1, L2 and L3 may be equal. A spacing 18, 19 has been provided between two respective stripe sections 15, 16 and 16, 17, which spacings each have a spacing dimension, L4 and L5 respectively, in the longitudinal direction L of the thermo-tape 6. In the present case the two spacing dimensions L4 and L5 are equal. However, it is obivous that alternatively the two spacing dimensions LA and L5 may differ from one another.

In the present thermo-tape unit 1 characteristics of the thermo-tape unit 1 are encoded by means of the section dimensions L1, L2 and L3 of the marking stripe sections 15, 16 and 17 and by means of the spacing dimensions L4 and L5 of the spacings 18 and 19 between the respective marking stripe sections 15, 16 and 16, 17. In other words, this means that the section dimensions L1, L2 and L3 and, in the present case, also the spacing dimensions L4 and L5 each serve as a code or a code element for at least one characteristic of the thermo-tape unit 1. However, alternatively it is possible to use only the section dimensions L1, L2 and L3 as codes. Different characteristics can be encoded, as required, for example the thermo-tape type, the overall length of the thermo-tape, the thermo-tape quality, the thermal characteristics of the activable ink layer of the thermo-tape or the manufacturer of the thermo-tape or the thermo-tape unit.

In the thermo-tape unit 1 shown in FIG. 1 the marking stripe sections 15, 16 and 17 consist of an optically scannable material having optical properties which differ from those of the thermo-tape 6. Suitably, the marking stripe sections are formed by a reflecting ink layer applied to the thermo-tape 6, which layer has reflection properties which differ from those of the thermo-tape 6. In practice, it has proved to be particularly advantageous if silver stripes are applied to the thermo-tape 6 as marking stripe sections 15, 16 and 17. Suitably, the marking stripe configuration 14 and, consequently, the marking stripe sections 15, 16 and 17 are arranged on the back side 13 of the thermo-tape 6.

When a thermo-tape unit 1 as shown in FIG. 1 is mounted in an apparatus adapted to cooperate with this thermo-tape unit 1, the marking stripe sections 15, 16 and 17 can be detected by means of a photo-electric sensor of this apparatus, enabling the section dimensions L1, L2 and L3 of the marking stripe sections 15, 16 and 17 as well as the spacing dimensions L4 and L5 of the spacings 18 and 19 to be detected in a simple manner. Thus, the information about the characteristics of the thermo-tape unit 1 derived from the section dimensions L1, L2 and L3 and the spacing dimensions L4 and L5, by means of which various characteristics of the thermo-tape unit 1 are encoded and which represent information about the characteristics of the thermo-tape unit 1, can be entered into the apparatus and processed in the apparatus. Depending on the information entered into the apparatus it possible, for example, to adjust certain apparatus units to given desired operating parameters and it is also possible, for example, to inhibit operation of the apparatus so as to preclude undesirable operation of the apparatus or damaging or impairment of apparatus units when information entered into the apparatus is not in agreement with the apparatus.

In a thermo-tape unit 1 as described above with reference to FIG. 1 it is achieved by particularly simple and cheap means, i.e. by means of the marking stripe configuration 14, that the entry of information about at least one characteristic of the thermotape unit 1 into an apparatus adapted to cooperate with this thermo-tape unit 1 is possible in a simple manner. With this thermo-tape unit 1 as shown in FIG. 1 it is further achieved that the introduction of the means, i.e. the marking stripe configuration 14, into the apparatus in order to enter information about at least one characteristic of the thermo-tape unit 1 into this apparatus is effected automatically when the thermo-tape unit 1 is mounted into this apparatus, without any separate means having to be handled. Since the marking stripe configuration 14 comprises three marking stripe sections 15, 16 and 17 it is simply possible to encode information about a plurality of characteristics of the thermo-tape unit 1 and enter this encoded information into an apparatus in a simple manner.

Figure 2:
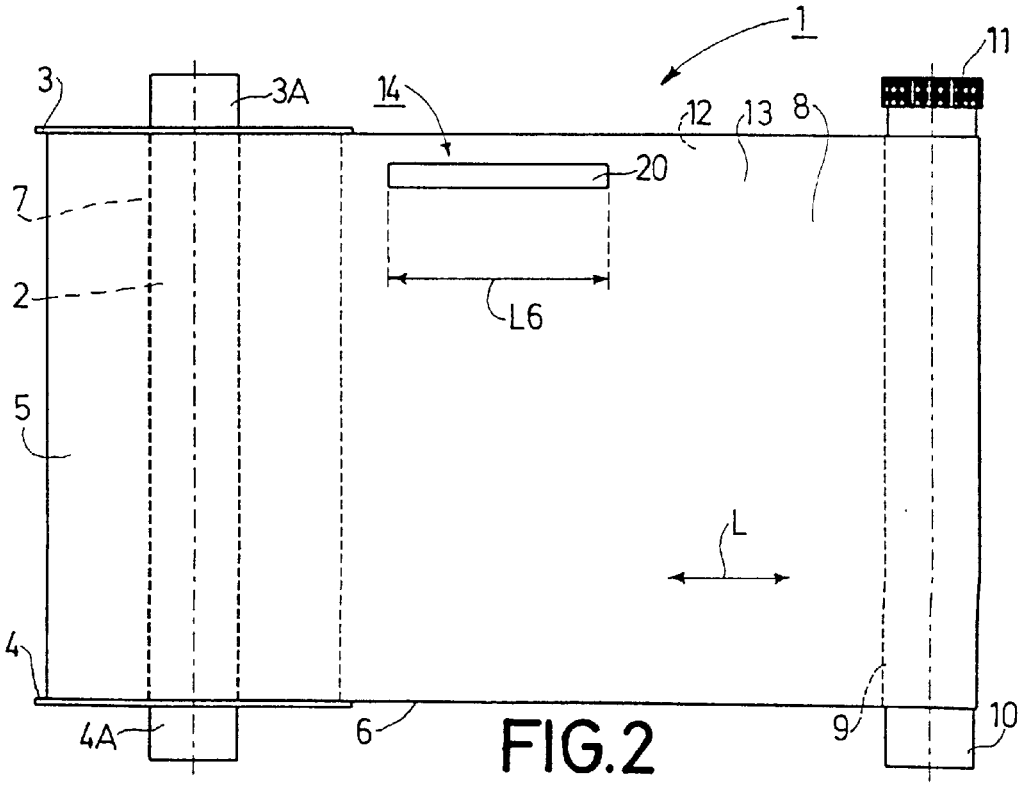
FIG. 2 is a plan view showing a thermo-tape unit in accordance with a second embodiment of the invention.

FIG. 2 shows a further thermo-tape unit 1 in which the marking stripe configuration 14 on the thermo-tape 6 comprises only one marking stripe section 20 which has a given section dimension L6 which extends in the longitudinal direction L of the thermo-tape 6. In the present case the section dimension L6 of the marking stripe section is used to encode one characteristic of the thermo-tape unit 1, namely the overall length or total capacity of the thermo-tape 6, i.e. the total number of A4 pages which can be printed by means of the thermo-tape 6 formed by a thermo-transfer foil. However, by means of the section dimension L6 it is also possible to encode two characteristics of the thermo-tape unit 1 at the same time.

Figure 3:
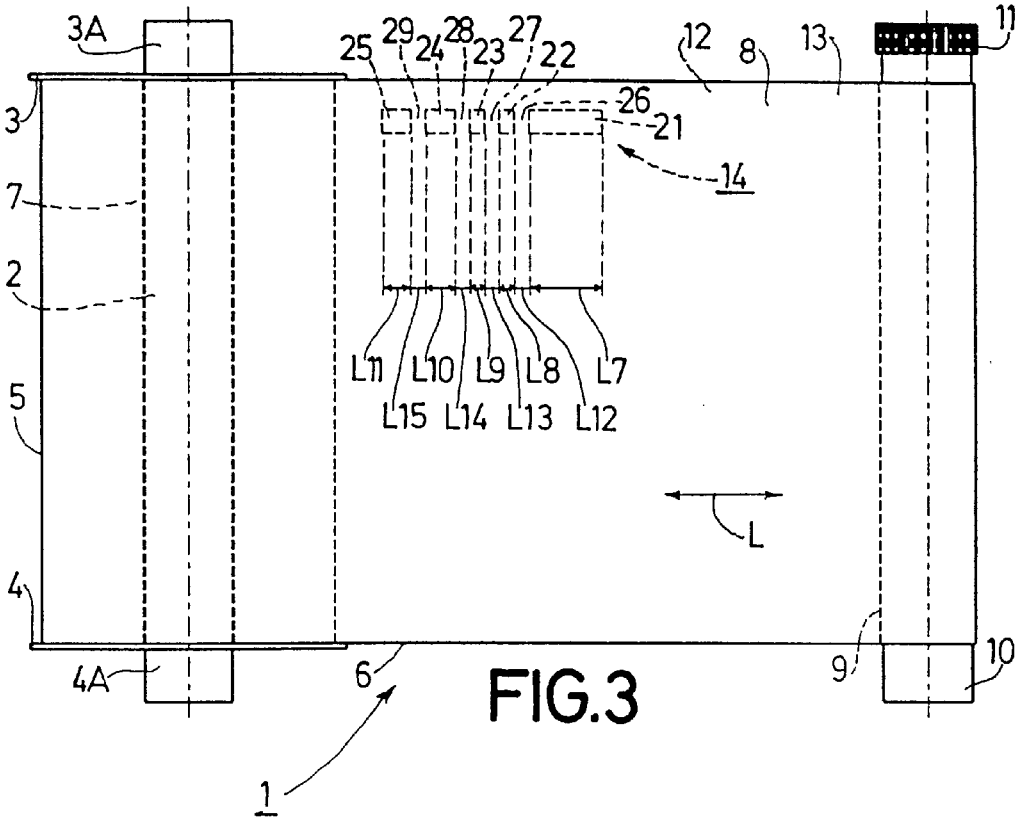
FIG. 3 shows, in a view similar to FIG. 2, a thermo-tape unit in accordance with a third embodiment of the invention.

FIG. 3 shows a further thermo-tape unit 1 in a view similar to that of FIG. 2. In this thermo-tape unit 1 a marking stripe configuration 14 has been provided, which comprises five marking stripe sections 21, 22, 23, 24, 25 which extend in the longitudinal direction L of the thermo-tape 6. The marking stripe sections 21, 22, 23, 24 and 25 each have a given section dimension L7, L8, L9, L10 and L11, respectively, in the longitudinal direction of the thermo-tape 6. A spacing 26, 27, 28 and 29 has been provided between every two marking stripe sections 21 and 22, 22 and 23, 23 and 24, and 24 and 25, respectively, which spacings each have a given spacing dimension L12, L13, L14 and L15, respectively, in the longitudinal direction L of the thermo-tape 6. In a manner similar to that in the thermo-tape unit 1 shown in FIG. 2 a plurality of characteristics of the thermo-tape unit 1 shown in FIG. 3 can be encoded by means of the section dimensions L7, L8, L9, L10 and L11 of the marking stripe sections 21, 22, 23, 24 and 25 and by means of the spacing dimensions L12, L13, L14 and L15 of the spacings 26, 27, 28 and 29. With respect to the marking stripe sections 21, 22, 23, 24 and 25 of the thermo-tape unit 1 shown in FIG. 3 it is to be noted that in the present case these sections are arranged at the front side 12 of the thermo-tape 6, for which reason the marking stripe sections 21, 22, 23, 24 and 25 are represented as invisible by means of broken lines.

Figure 4:
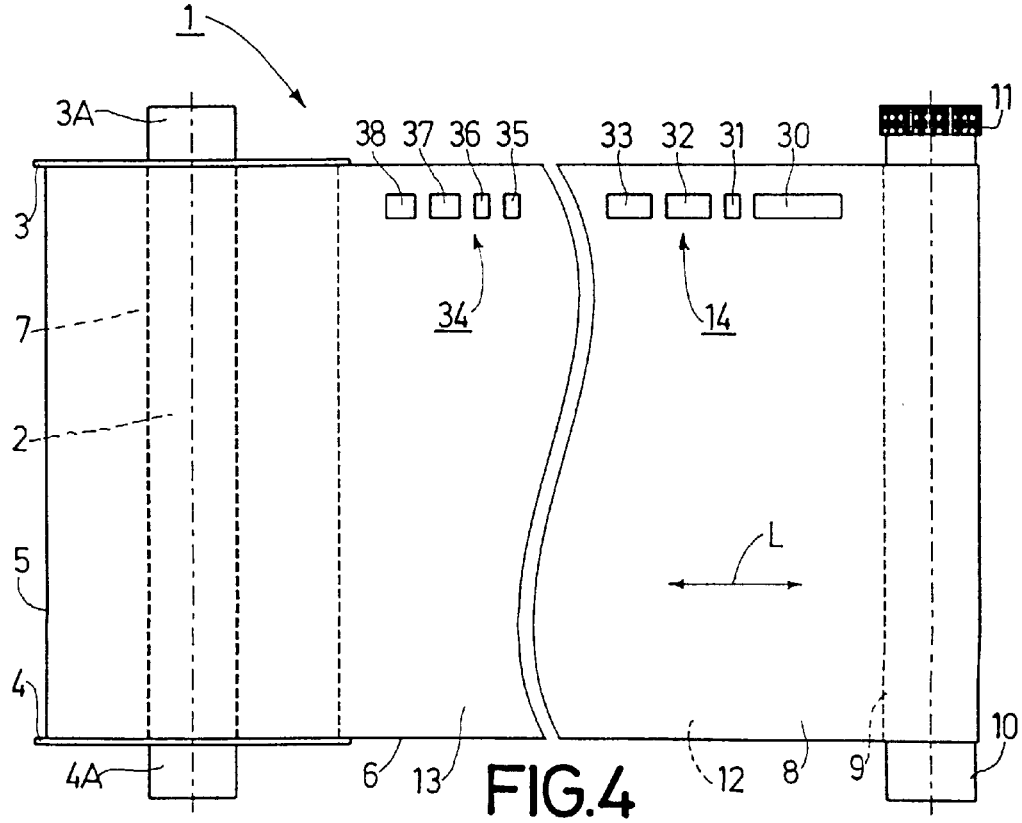
FIG. 4 shows, in a view similar to FIGS. 2 and 3, a thermo-tape unit in accordance with a fourth embodiment of the invention.

FIG. 4 shows a further thermo-tape unit 1 in a view similar to those of FIGS. 2 and 3. The special feature of this thermo-tape unit 1 is that in addition to the marking stripe configuration 14 in the leading area 8 of the thermo-tape 6, which in the present case comprises four marking stripe sections 30, 31, 32 and 33, there has been provided a plurality of further marking stripe configurations disposed in line with this marking stripe configuration 14 in the longitudinal direction L of the thermo-tape 6, of which FIG. 4 shows only one further marking stripe configuration 24 for the sake of simplicity. The further marking stripe configuration 34 comprises four marking stripe sections 35, 36, 37 and 38 which have other section dimensions than the four marking stripe sections 30, 31, 32 and 33.

The major advantage of such a construction of a thermo-tape unit 1 is that by means of the further marking stripe configurations, whose marking stripe sections change along the thermo-tape 6, it is possible to enter up-to-date information about characteristics of the thermo-tape unit 1 and its thermo-tape 6 into an apparatus. By means of the further marking stripe configurations it is simply possible to enter the currently available residual tape length of the thermo-tape 6 as information about a characteristic of the thermo-tape unit 1 into an apparatus.

The invention is not limited to the examples described hereinbefore. The invention can also be used advantageously in a thermo-tape unit whose thermo-tape is a so-called thermo-paper on which visible information such as alphanumeric characters and the like can be formed by point-by-point heating by means of a thermal printer head. The marking stripe sections of marking stripe configurations can also have a section length which extends transversely to the longitudinal direction of a thermo-tape and a section width which extends parallel to the longitudinal direction of a thermo-tape, at least one characteristic of a thermo-tape unit being encoded by means of the section width which extends in the longitudinal direction of the thermo-tape.

I claim:

1. A thermo-tape unit comprising a supply reel hub and a supply roll of thermo-tape wound on the supply reel hub, which thermo-tape has a trailing area adjoining the supply reel hub and a leading area remote from the supply reel hub, and a front side provided with an ink layer activable under the influence of heat and a back side at the reverse of the front side, characterized in that at least in its leading area the thermo-tape has at least one marking stripe configuration which comprises at least one marking stripe section having a given section dimension which extends in the longitudinal direction of the thermo-tape, and at least one characteristic of the thermo-tape unit is encoded by means of the section dimension which extends in the longitudinal direction of the thermo-tape.

2. A thermo-tape unit as claimed in claim 1, characterized in that the at least one marking stripe configuration comprises at least two marking stripe sections which extend in the longitudinal direction of the thermo-tape and which each have a given section dimension which extends in the longitudinal direction of the thermo-tape, a spacing being provided between said at least two marking stripe sections, which spacing has a given spacing dimension which extends in the longitudinal direction of the thermo-tape, and at least one characteristic of the thermo-tape unit is encoded by means of the section dimension of at least one marking stripe section, which section dimension extends in the longitudinal direction of the thermo-tape, and by means of the spacing dimension of at least one spacing between two marking stripe sections, which spacing dimension extends in the longitudinal direction of the thermo-tape.

3. A thermo-tape unit as claimed in claim 1, characterized in that the at least one marking stripe section consists of an optically scannable material having optical properties which differ from those of the thermo-tape.

4. A thermo-tape unit as claimed in claim 3, characterized in that the at least one marking stripe section is formed by a reflecting ink layer applied to the thermo-tape, which layer has reflection properties which differ from those of the thermo-tape.

5. A thermo-tape unit as claimed in claim 1, characterized in that in addition to the marking stripe configuration in the leading area of the thermo-tape, there has been provided at least one further marking stripe configuration disposed in line with this marking stripe configuration in the longitudinal direction of the thermo-tape.

6. A thermo-tape unit as claimed in claim 1, characterized in that the at least one marking stripe configuration is disposed on the back side of the thermo-tape.

7. A thermo-tape unit as claimed in claim 1, characterized in that the thermo-tape is formed by a thermo-transfer foil whose front side has been provided with an ink layer which is removable under the influence of heat.

* * * * *